US007553183B2

(12) United States Patent
Taketomi et al.

(10) Patent No.: US 7,553,183 B2
(45) Date of Patent: Jun. 30, 2009

(54) FLAT CIRCUIT CONNECTOR WITH PIVOTED ACTUATOR

(75) Inventors: Kousuke Taketomi, Kanagawa (JP); Atsuhito Horino, Kanagawa (JP); Tomonari Kaneko, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/631,727

(22) PCT Filed: Jul. 1, 2005

(86) PCT No.: PCT/US2005/023548

§ 371 (c)(1),
(2), (4) Date: Jul. 22, 2008

(87) PCT Pub. No.: WO2006/031279

PCT Pub. Date: Mar. 23, 2006

(65) Prior Publication Data

US 2008/0293282 A1 Nov. 27, 2008

(30) Foreign Application Priority Data

Jul. 6, 2004 (JP) ..... 2004-198796

(51) Int. Cl.
*H01R 12/24* (2006.01)

(52) U.S. Cl. ..... 439/495; 439/260

(58) Field of Classification Search ..... 439/495, 439/260

See application file for complete search history.

(56) References Cited

U.S. PATENT DOCUMENTS 5,580,272 A 12/1996 Yamaguchi et al.
5,839,917 A * 11/1998 Takahashi et al. ..... 439/495
5,842,883 A * 12/1998 Igarashi et al. ..... 439/495
6,056,571 A * 5/2000 Noro ..... 439/260
6,116,947 A * 9/2000 Takayasu ..... 439/495
6,997,729 B2 * 2/2006 Sunaga ..... 439/260
7,052,300 B2 * 5/2006 Okita et al. ..... 439/260
7,086,884 B2 * 8/2006 Okano ..... 439/260
7,232,333 B2 * 6/2007 Chen ..... 439/495
7,318,737 B2 * 1/2008 Yokoyama ..... 439/260
7,351,070 B2 * 4/2008 Hirai ..... 439/67
2005/0255732 A1 * 11/2005 Sunaga ..... 439/260
2006/0121776 A1 * 6/2006 Kao ..... 439/495
2006/0183364 A1 * 8/2006 Suzuki et al. ..... 439/260
2006/0199410 A1 * 9/2006 Chen ..... 439/260

(Continued)

FOREIGN PATENT DOCUMENTS

EP 0 743 715 A2 11/1996

(Continued)

*Primary Examiner*—Ross N Gushi
(74) *Attorney, Agent, or Firm*—Timothy M. Morella

(57) ABSTRACT

An electrical connector is provided for terminating a flat electrical circuit. The connector includes a dielectric housing having an opening at a front end thereof for receiving an end of the flat circuit. A plurality of terminals are mounted on the housing in a side-by-side array and spaced laterally along the opening. An actuator is movably mounted for pivotal movement between an open position allowing the flat circuit to be inserted into the opening with substantially zero insertion forces, a closed position biasing the flat circuit against contact portions of the terminals and an intermediate position whereat the flat circuit is tentatively held in stable condition while allowing readjustment thereof.

18 Claims, 10 Drawing Sheets

U.S. PATENT DOCUMENTS

| | | | | |
|---|---|---|---|---|
| 2006/0270270 | A1* | 11/2006 | Yokoyama | 439/495 |
| 2007/0010127 | A1* | 1/2007 | Takahira | 439/495 |
| 2007/0066127 | A1* | 3/2007 | Inoue | 439/495 |
| 2007/0117451 | A1* | 5/2007 | Yokoyama | 439/495 |
| 2008/0293282 | A1* | 11/2008 | Taketomi et al. | 439/296 |

FOREIGN PATENT DOCUMENTS

| | | | |
|---|---|---|---|
| EP | 1 311 028 | A2 | 5/2003 |
| EP | 1 378 966 | A1 | 1/2004 |
| JP | 2002-329536 | | 11/2002 |

* cited by examiner

FLAT CIRCUIT CONNECTOR WITH PIVOTED ACTUATOR

FIELD OF THE INVENTION

This invention generally relates to the art of electrical connectors and, particularly, to a connector for terminating a flat circuit, such as a flat flexible circuit, a flexible printed circuit or other flat electrical cable.

BACKGROUND OF THE INVENTION

A wide variety of electrical connectors have been designed for terminating flat cables or circuits, such as flat flexible cables, flexible printed circuits or the like. A typical connector for flat circuits includes a dielectric housing molded of plastic material, for instance. The housing has an elongated opening or slot for receiving an end of the flat circuit which has generally parallel, laterally spaced conductors exposed across the end. A plurality of terminals are mounted in the housing and are spaced laterally along the slot, with contact portions of the terminals engageable with the laterally spaced conductors of the flat circuit. An actuator often is movably mounted on the housing for movement between a first position whereat the flat circuit is freely insertable into the slot and a second position whereat the actuator clamps the circuit in the housing and biases the circuit against the contact portions of the terminals.

Examples of such flat circuit connectors are shown in Japanese Patent Laid-Open No. 2002-134194; No. 2002-329536; and No. 2003-45526.

The contact portions of the terminals in such flat circuit connectors are spaced inwardly of the inlet to the elongated opening or slot in the housing for receiving the end of the flat circuit. Heretofore, most such flat circuit connectors originally created substantial resistance to insertion of the circuit into the opening and into engagement with the contact portions of the terminals. In fact, some of the contacts on the flat circuit often were deformed or damaged.

Consequently, flat circuit connectors have been designed so that the opening in the connector housing, including the interior area at the contact portions of the terminals, is wider than the thickness of the flat circuit. Therefore, the flat circuit can be inserted into the opening with no substantial resistance forces (commonly called "zero insertion force" or "ZIF"). This permits the flat circuit to be inserted with ease and prevents deformation or damage to either the contacts on the flat circuit or the contact portions of the connector terminals.

Unfortunately, such zero insertion force connectors often are too loose or free during insertion of the flat circuit. The circuit cannot be tentatively held in position, prior to final clamping, to provide for correct reinsertion or readjustment of the circuit prior to its final clamped and terminated condition. The present invention is directed to solving these problems by providing a flat circuit connector having an actuator which not only is movable between a first position allowing free insertion of the flat circuit and a second position clamping the circuit in terminated position, but the actuator is movable to an intermediate position facilitating tentative holding of the flat circuit in stable condition while allowing readjustment thereof.

SUMMARY OF THE INVENTION

An object, therefore, of the invention is to provide a new and improved flat circuit connector of the character described.

In the exemplary embodiment of the invention, an electrical connector is provided for terminating a flat electrical circuit. The connector includes a dielectric housing having an opening at a front end thereof for receiving an end of the flat circuit. A plurality of terminals are mounted on the housing in a side-by-side array and spaced laterally along the opening. An actuator is movably mounted for pivotal movement between an open position allowing the flat circuit to be inserted into the opening with substantially zero insertion forces, a closed position biasing the flat circuit against contact portions of the terminals and an intermediate position whereat the flat circuit is tentatively held in stable condition while allowing readjustment thereof.

According to one aspect of the invention, some of the terminals are generally U-shaped to define an upper hook arm extending over the opening and a lower contact arm extending below the opening. The hook arm has a bearing portion and the contact arm has a contact portion. The flat circuit is tentatively held between the bearing portion and the contact portion in the intermediate position of the actuator. Hook portions of the terminals cooperate with pivot means on the actuator to mount the actuator for pivotal movement between said positions. The terminals have detent means engageable with complementary detent means on the actuator to hold the actuator in its intermediate position. As disclosed herein, the detent means comprise interengaging flat surfaces on the actuator and the terminals. These terminals are mounted on the housing from the front end thereof. According to the preferred embodiment, the terminals have tail portions for connection to appropriate circuit traces on a printed circuit board.

According to another aspect of the invention, some of the terminals are generally U-shaped to define an upper cam arm extending over the opening and a lower contact arm extending below the opening. The upper cam arm engages a cam portion of the actuator to lift the actuator in its intermediate position. These terminals are mounted on the housing from a rear end thereof. In the preferred embodiment, the terminals have tail portions for connection to the circuit traces on the printed circuit board.

According to a further aspect of the invention, at least one fitting nail is fixed to the housing for securement to the printed circuit board. The fitting nail has a bearing portion for engaging the actuator and facilitating pivotally mounting the actuator on the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 2(*b*) is a view similar to that of FIG. 2(*a*), but taken along a selected second terminal;

FIG. 2(*c*) is a front-to-rear vertical section taken along one of the fitting nails of the connector, with the actuator again in its closed or terminating position;

DETAILED DESCRIPTION OF THE PREFERRED EMBODIMENTS

Figure 1:
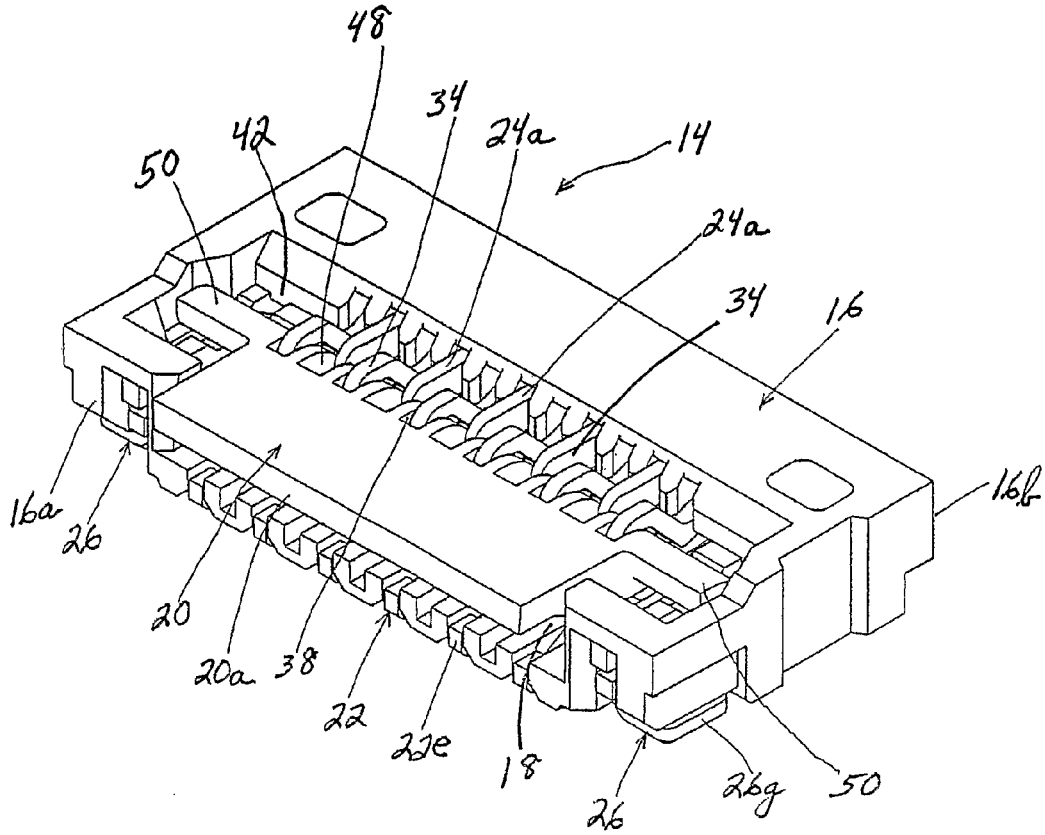
FIG. 1 is a perspective view of a flat circuit connector according to a first embodiment of the invention.
Figure 2:
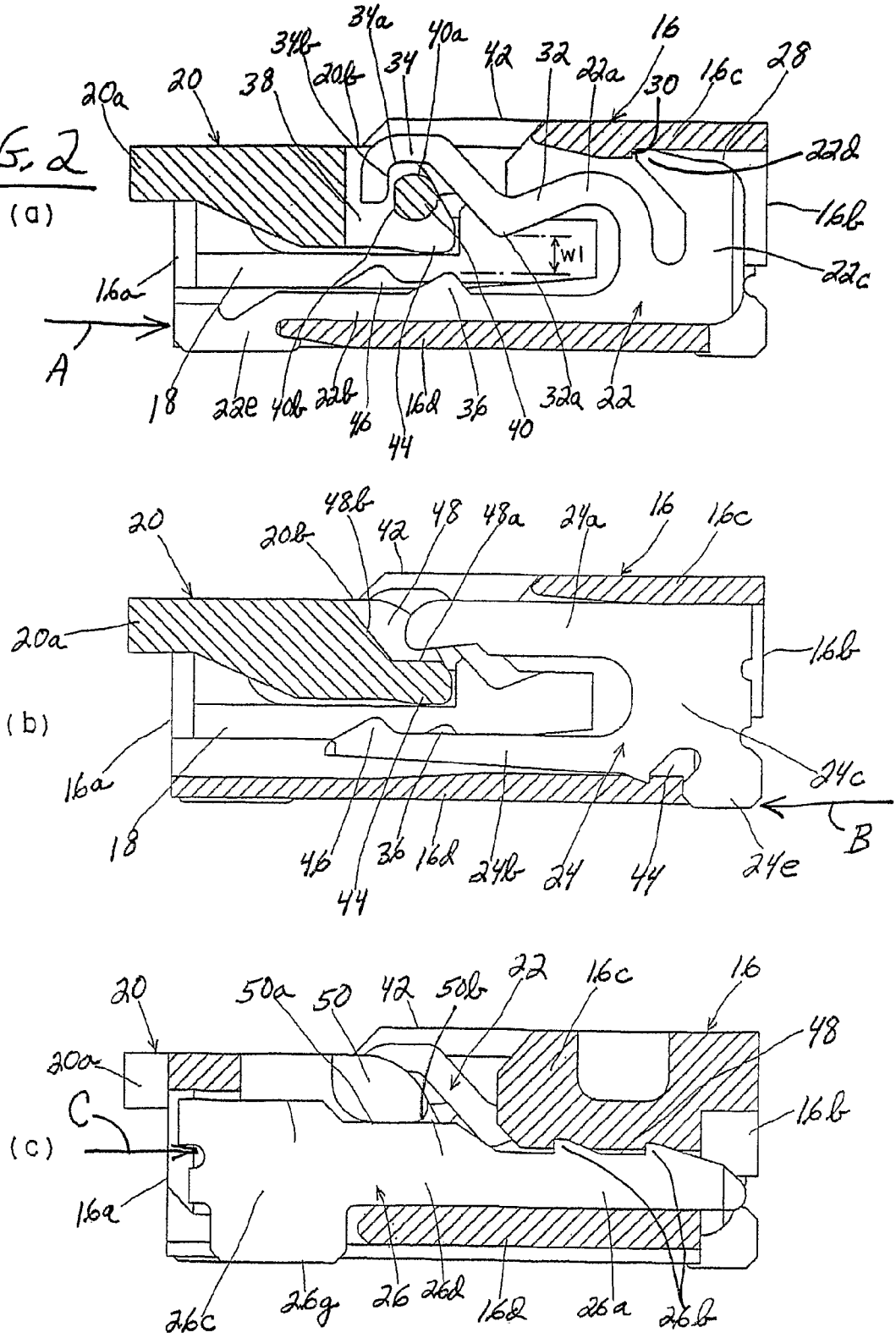
FIG. 2(*a*) is a front-to-rear vertical section through the connector of FIG. 1 and taken along a selected first terminal, with the actuator in its closed or terminating position, but with the flat circuit omitted to facilitate the illustration.

Referring to the drawings in greater detail, and first to FIGS. 1 and 2, the invention is embodied in a flat circuit electrical connector, generally designated 14 (FIG. 1) according to a first embodiment of the invention. The connector is designed for mounting on a printed circuit board (not shown). The connector includes a dielectric housing, generally designated 16, having a front end 16*a* and a rear end 16*b*. The housing defines an opening 18 which opens at the front end for receiving an end of a flat circuit as will be seen hereinafter. The housing is a one-piece structure molded of dielectric material such as plastic or the like. An actuator, generally designated 20, is movably mounted for pivotal movement between an open position (described hereinafter) allowing the flat circuit to be inserted into opening 18 with substantially zero insertion forces and a closed position shown in FIGS. 1 and 2 biasing the flat circuit against contact portions of a plurality of terminals, again as will be described in greater detail hereinafter. Generally, actuator 20 is pivotally movable to an intermediate position whereat the flat circuit is tentatively held in stable condition while allowing readjustment thereof.

More particularly, FIG. 2(*a*) shows one of a plurality of first terminals, generally designated 22, and FIG. 2(*b*) shows one of a plurality of second terminals, generally designated 24. The first and second terminals are staggered and spaced laterally along opening 18 in a side-by-side array. FIG. 2(*c*) shows a fitting nail, generally designated 26, which is mounted in the connector housing 16 at each extreme opposite side or end of opening 18.

Each first terminal 22 is generally U-shaped to define an upper flexible hook arm 22*a* and a lower rigid contact arm 22*b*. Each first terminal 22 is inserted in the direction of arrow "A" into a respective terminal slot 28 in housing 16. The terminal has a rear engagement portion 22*c* which has a forwardly projecting latch portion 22*d* which latches behind an interior latch shoulder 30 formed on the underside of a ceiling plate 16*c* of the housing. A tail portion 22*e* of the terminal abuts against a front edge of a floor plate 16*d* of the housing. The tail portion is connected to an appropriate circuit trace on the printed circuit board.

Still referring, to FIG. 2(*a*), the flexible upper hook arm 22*a* of each first terminal 22 has a hook portion 32 defining a downwardly projecting bearing portion 32*a* which extends into opening 18. The upper hook arm terminates in a front, downwardly opening hook portion 34 having an interior horizontal flat surface 34*a* and a front vertical flat surface 34*b*. Finally, lower contact arm 22*b* of each first terminal 22 has an upwardly projecting contact portion 36 generally intermediate opposite ends of the contact arm and extending upwardly into opening 18.

Still referring to FIG. 2(*a*), actuator 20 includes a front end 20*a* and a rear end 20*b*. A plurality of slots 38 are formed in the rear end of the actuator and are spaced longitudinally thereof for accommodating hook portions 34 of first terminals 22. A pivot pin 40 spans each slot 38 and is disposed generally within the hook portion of each terminal. The pivot pin has a circular surface 40*a* and a flat surface 40*b*. Opening 18 is open at the top of housing 16, as at 42, to accommodate pivoting movement of the actuator, as will be seen hereinafter. The actuator has a pressing end 44 projecting inwardly from pivot pins 40.

Referring to FIG. 2(*b*), each second terminal 24 is generally U-shaped to define a rigid upper cam arm 24*a* which extends over opening 18 and a lower contact arm 24*b* which extends below the opening. The arms project forwardly of a mounting portion 24*c* which has a latch tooth 24*d* that bites into the plastic material of floor plate 16*d* of the housing to fix the terminal in the housing. Second terminals 24 are inserted in the direction of arrow "B", into respective slots 44 from rear end 16*b* of housing 16. A tail portion 24*e* projects downwardly from mounting portion 24*c* for connection to an appropriate circuit trace on the printed circuit board. Finally, a contact portion 46 projects upwardly into opening 18 at a distal end of the lower contact arm 24*b* of each second terminal 24.

Still referring to FIG. 2(*b*), actuator 20 has a plurality of slots 48 spaced along rear end 20*b* of the actuator for accommodating the forward distal ends of upper cam arms 24*a* of second terminals 24. Each slot 48 has a platform surface 48*a* and a ramp surface 48*b*, for purposes described hereinafter.

Referring to FIG. 2(*c*), each fitting nail 26 is inserted in the direction of arrow "C" into a respective mounting slot 48 within the housing. Each fitting nail has a forwardly extending mounting post 26*a* having teeth 26*b* for skiving into the plastic material of the housing within mounting slot 48 to fix the fitting nail to the housing. The fitting nail has a generally square base 26*c* and a generally rectangular rearward extension or bearing portion 26*d*. The square base has an upper edge 26*e*, and the rectangular extension has an upper edge 26*f*. Upper edge 26*e* of square base 26*c* is higher than upper edge 26*f* of rectangular extension 26*b*. The base forms a tail portion 26*g* for connection, as by soldering, to a mounting pad on the printed circuit board. Upper edge 26*f* of the fitting nail is exposed in a vertical direction in the open area 42 of the housing above opening 18.

Still referring to FIG. 2(*c*), actuator 20 includes a bearing boss or wing 50 which has a flat surface 50*a* and an accurate surface 50*b*. In the closed position of FIG. 2(*c*), the flat surface 50*a* of the bearing boss engages the upper edge 24*c* of bearing portion 26*d* of the fitting nail. As seen in FIG. 1, a pair of the bearing bosses or wings 50 project outwardly from opposite sides of actuator 20 for engaging the tops of fitting nails 26. FIG. 1 also shows that tail portions 26*g* of the fitting nails are generally flat in a horizontal plane for secure connection, as by soldering, to the mounting pads on the printed circuit board.

All of the staggered first and second terminals 22 and 24, respectively, along with the two fitting nails 26, may be stamped and formed of conductive sheet metal material. For instance, the fitting nails may be stamped out of stainless steel. It also can be understood from the above detailed description, that actuator 20 is captured on housing 16 by bearing wings 50 engaging the tops of fitting nails 26, while pivot pins 40 (FIG. 2(*a*)) are captured within the undersides of hook portions 34 of first terminals 22. FIG. 2 shows the actuator in its closed position for clamping the flat circuit against contact portions 36 and 46 of first and second terminals 22 and 24, respectively, as will be seen hereinafter.

Figure 3:
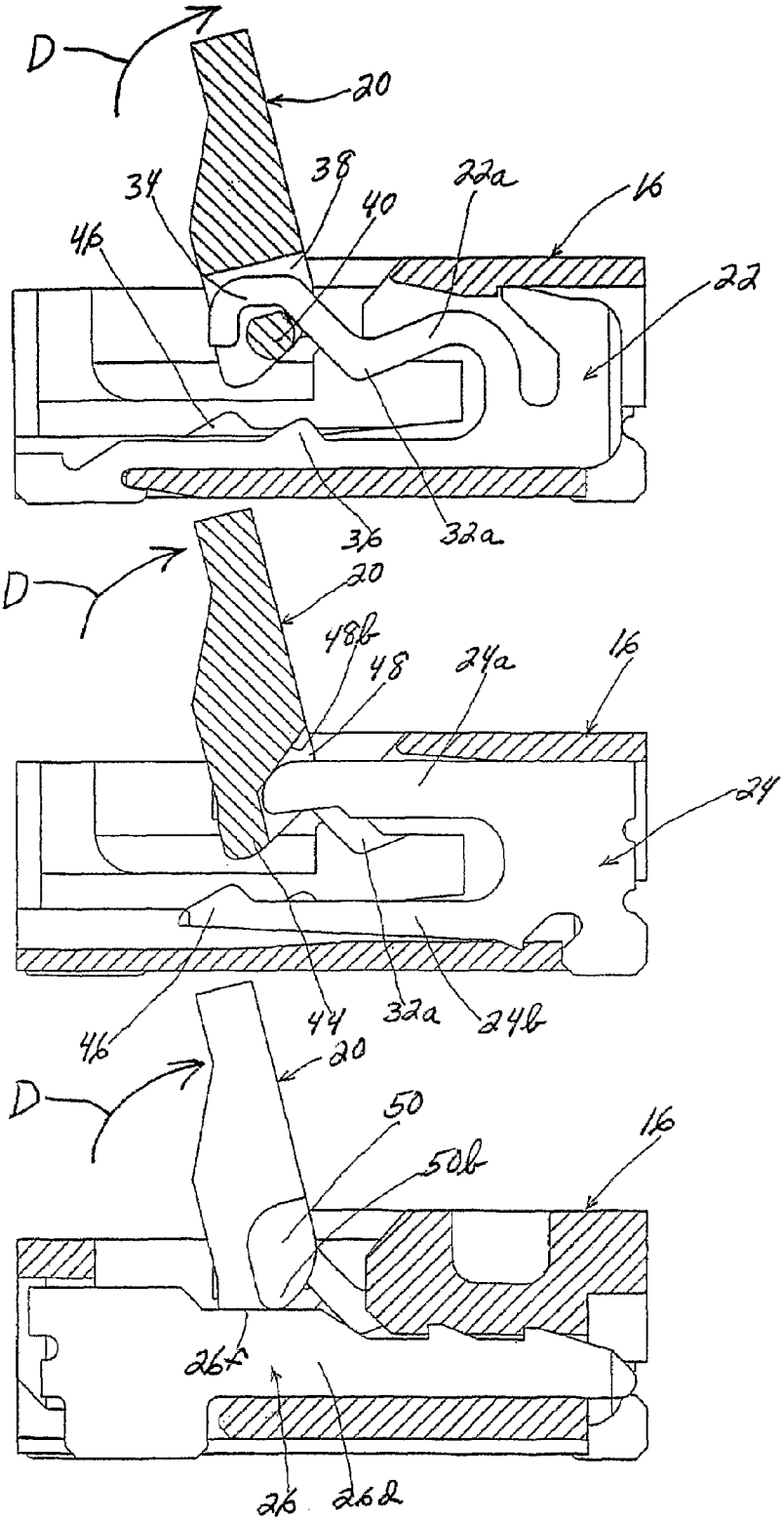
FIGS. 3(*a*), (*b*) and (*c*) are views similar to that of FIGS. 2(*a*), (*b*) and (*c*), but with the actuator pivoted upwardly from its closed position.
Figure 4:
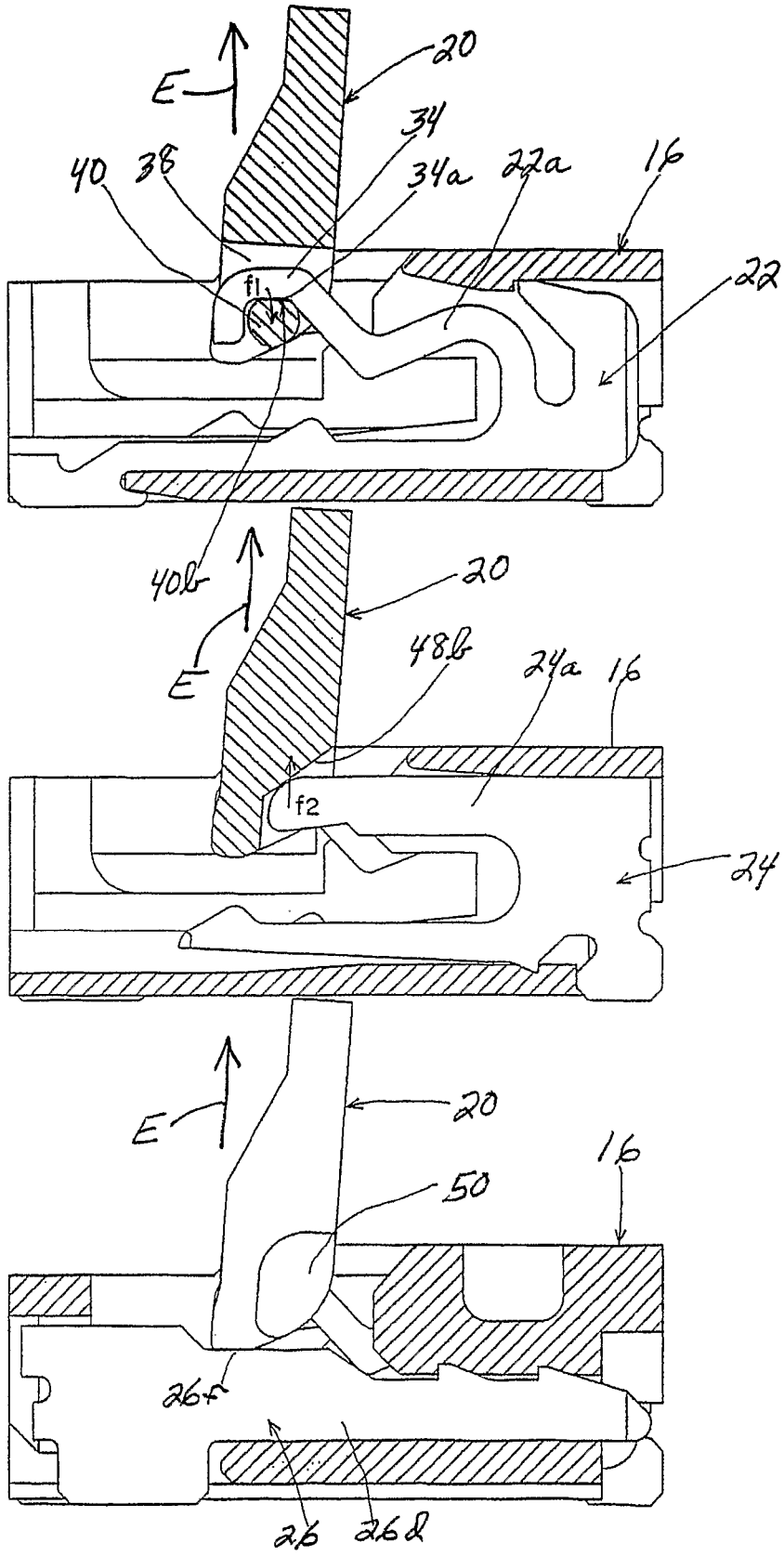
FIGS. 4(*a*), (*b*) and (*c*) are views similar to that of FIGS. 3(*a*), (*b*) and (*c*), but with the actuator pivoted upwardly to its intermediate position.

As can be seen in FIG. 2(*a*), pivot pins 40 are spaced below horizontal flat surfaces 34*a* of hook portions 34 of first terminals 22. Actuator 20 is pivotally rotated from its closed position shown in FIG. 2, upwardly in the direction of arrows "D" (FIG. 3), until the actuator reaches a generally vertical, intermediate position shown in FIG. 4. During the rotation shown in FIG. 3, ramp surfaces 48*b* (FIG. 3(*b*)) on the actuator engage the distal ends of upper cam arms 24*a* of second terminals 24. This applies upward forces "f2" (FIG. 4(*b*)) to the actuator. Simultaneously, accurate surfaces 50*b* of bearing bosses or wings 50 engage upper edges 26*f* of fitting nails 26 as seen in FIG. 3(*c*). These interengagements of the actuator with the second terminals and the fitting nails cause actuator 20 to be lifted upwardly in the direction of arrows "E" (FIG. 4). When the actuator is lifted, flat surfaces 40*b* (FIG. 4(*a*)) of pivot pins 40 engage horizontal flat surfaces 34*a* of hook portions 34 of first terminals 22. These interengaging flat surfaces form detent means to hold the actuator in its intermediate position of FIG. 4.

The affect of rotating actuator 20 from its closed position of FIG. 2 to its intermediate position of FIG. 4 should be further explained in relation to upper hook arms 22*a* of first terminals 22. Specifically, as the actuator is pivoted upwardly, the distal ends of rigid cam arms 24*a* (FIG. 4(*b*)) of second terminals 24 apply a force "f2" to ramp surface 48*b* of the actuator. This causes the flexible upper hook arms 22*a* to yieldably bend upwardly, applying a reactionary force (f1) to pivot pins 40 of the actuator. FIG. 2(*a*) shows a gap (W1) between bearing portions 32*a* and contact portions 36 of the first terminals when the actuator is in its closed position. When the actuator is pivoted upwardly, this gap is enlarged.

Figure 5:
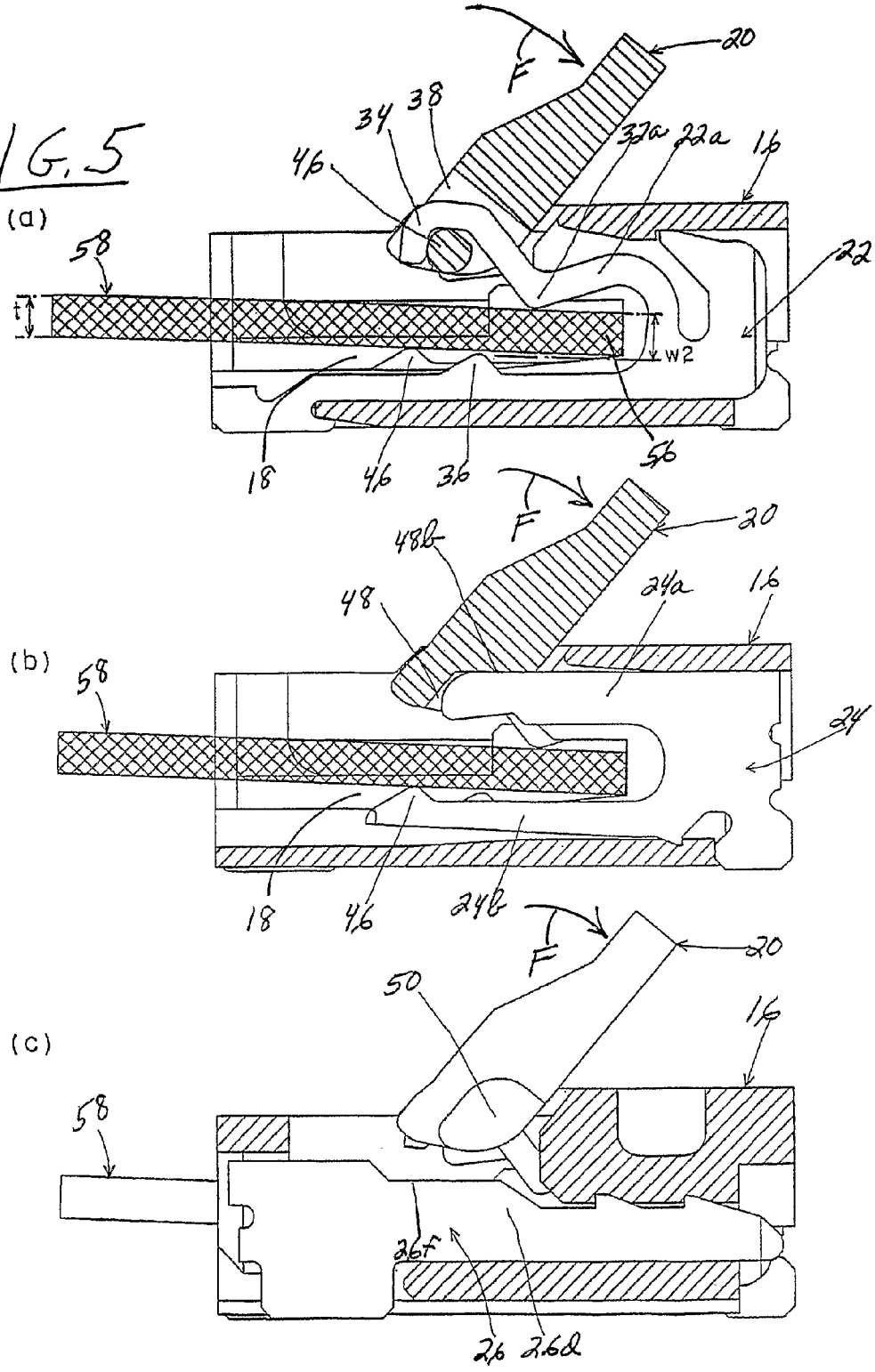
FIGS. 5(*a*), (*b*) and (*c*) are views similar to that FIGS. 4(*a*), (*b*) and (*c*), but with the actuator pivoted to its fully open position and with a flat circuit inserted into the connector.

FIG. 5 shows actuator 20 pivoted further from its intermediate position of FIG. 4 to its completely open position allowing an end 56 of a flat circuit 58 to be inserted into opening 18 in housing 16 of the connector with zero insertion force. The flat circuit has a thickness "t". This thickness is smaller than gap "W2" between bearing portions 32*a* and contact portions 36 of first terminals 22. Therefore, although the bottom surface of flat circuit 58 may engage contact portions 46 of second terminals 24, the flat circuit can be inserted into all of the U-shaped terminals 22 and 24 with zero insertion forces.

Figure 6:
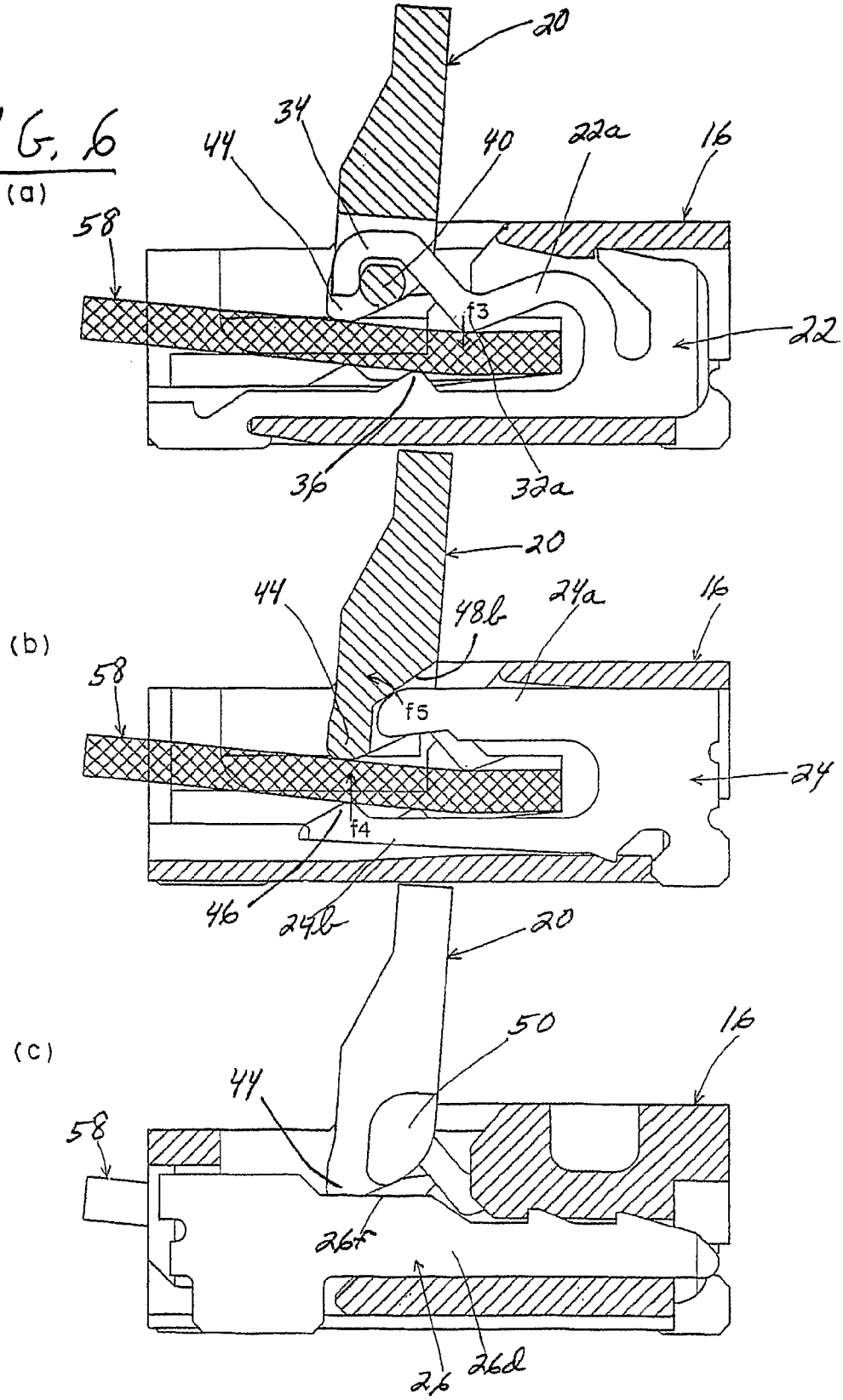
FIGS. 6(*a*), (*b*) and (*c*) are views similar to that of FIGS. 4(*a*), (*b*) and (*c*), but with the flat circuit inserted into the connector.

After flat circuit 58 is inserted into the connector with actuator 20 in its open position of FIG. 5, the actuator is pivoted back to its intermediate position as shown in FIG. 6. In this intermediate position of the actuator, the flat circuit is tentatively held in stable condition while still allowing readjustment of the circuit, such as correcting its final position. This tentative holding condition of the actuator is afforded by the application of forces "f3" by upper hook arms 22*a* of first terminals 22, as bearing portions 32*a* of the hook arms engage the top of the flat circuit. In other words, the flat circuit is sandwiched between bearing portions 32*a* and contact portions 36 of the first terminals. These forces do not rigidly clamp the flat circuit but temporarily hold the circuit while allowing readjustment thereof. Although pressing end 44 of actuator 20 is in engagement with the top surface of flat circuit 58, no clamping forces have yet to be applied. In other words, the distal ends of upper cam arms 24*a* (FIG. 6(*b*)) of second terminals 24 are applying a force "f5" to ramp surfaces 48*b* of the actuator to keep the actuator in its elevated position. Contact portions 46 of lower contact arms 24*b* of second terminals 24 apply a reactionary or supporting force "f4" to the underside of the flat circuit. FIG. 6(*c*) also shows that pressing end 44 of actuator 20 is in engagement with upper edges 26*f* of fitting nails 26, also to maintain the actuator elevated so that the flat circuit is only tentatively held.

Figure 7:
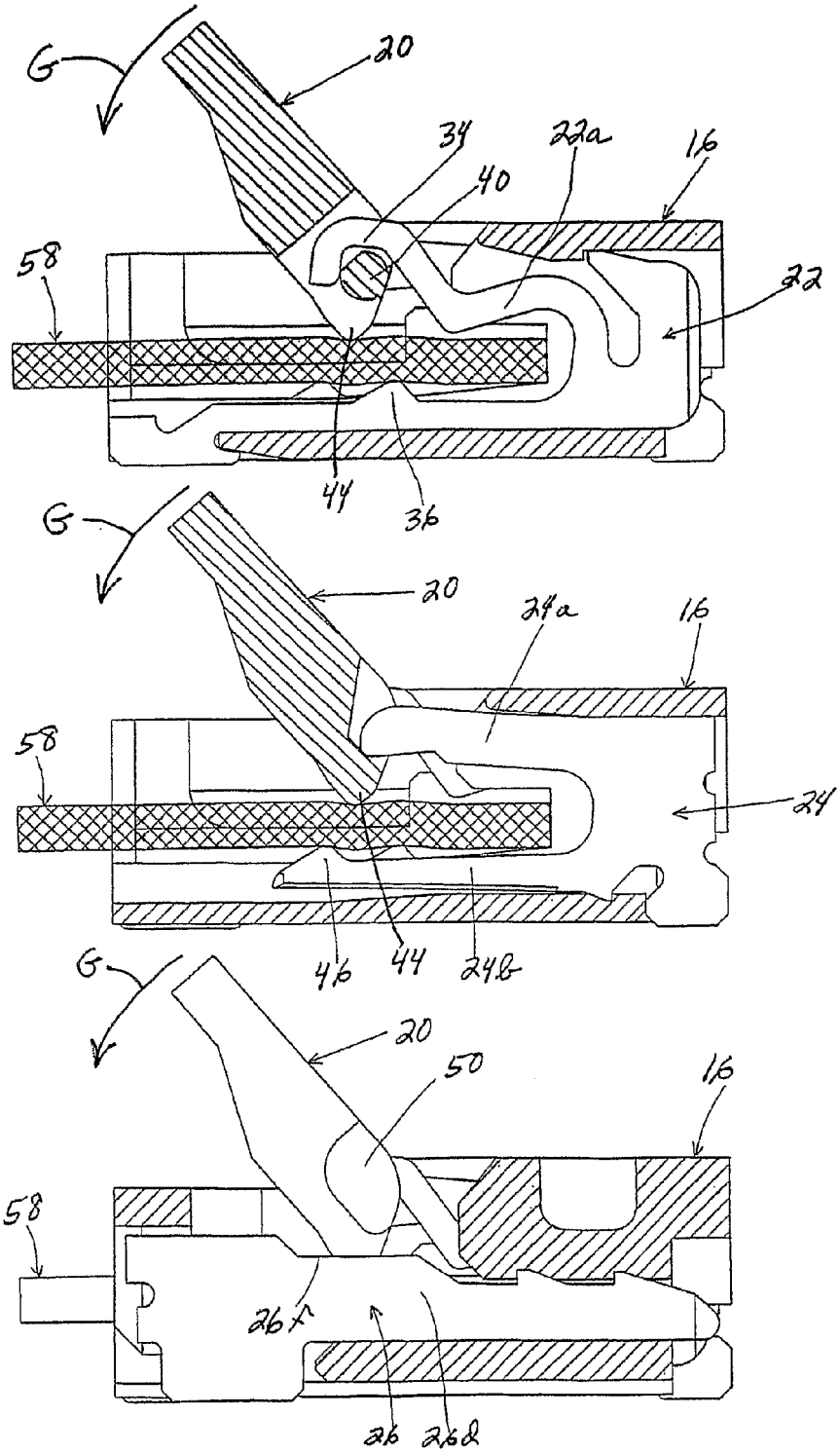
FIGS. 7(*a*), (*b*) and (*c*) are views somewhat similar to that of FIGS. 3(*a*), (*b*) and (*c*), but with the flat circuit inserted into the connector.
Figure 8:
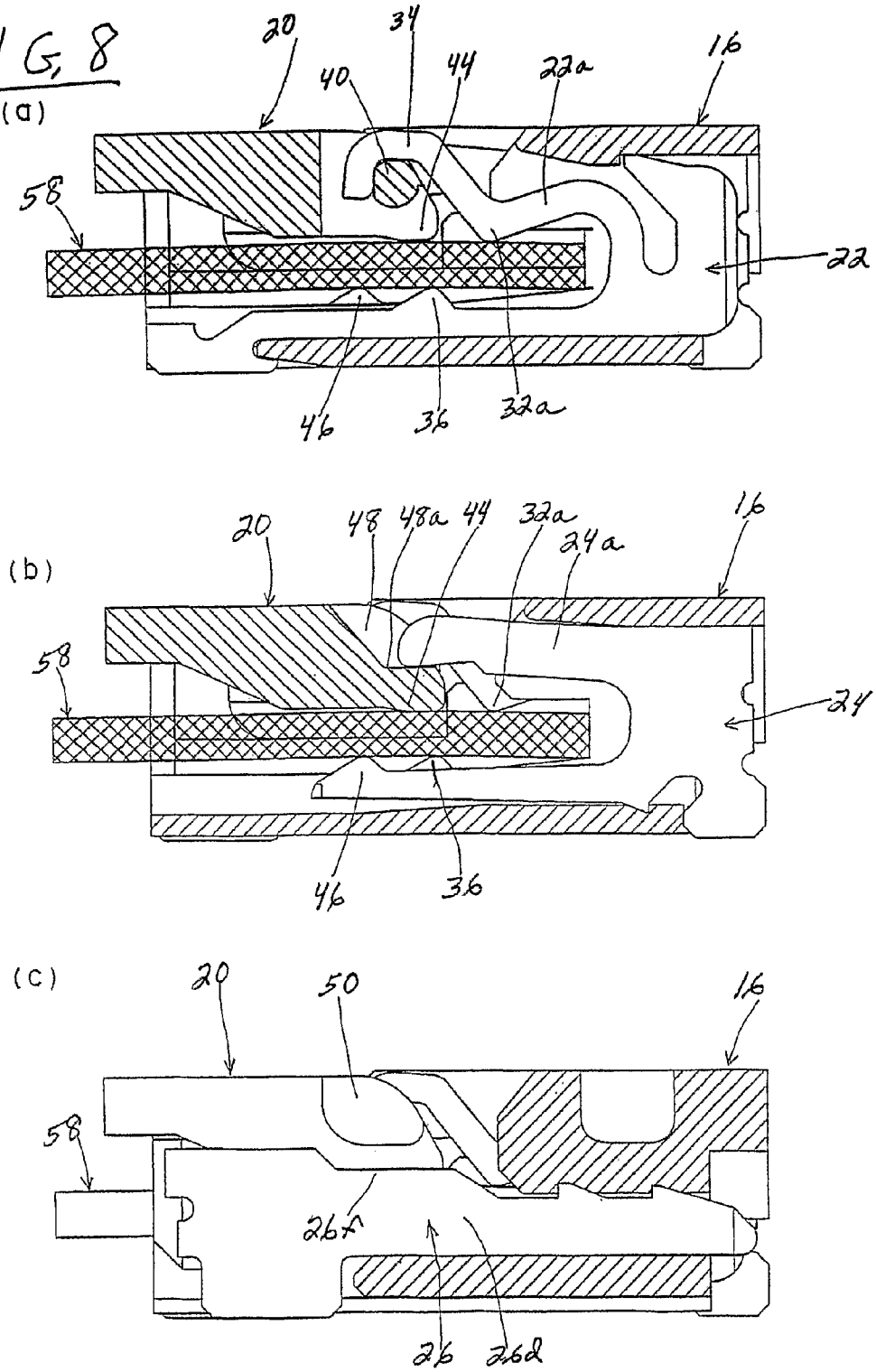
FIGS. 8(*a*), (*b*) and (*c*) are views similar to that of FIGS. 2(*a*), (*b*) and (*c*), but with the flat circuit inserted into the connector.

As actuator 20 is pivoted downwardly in the direction of arrows "G" in FIG. 7 to its closed or terminating position of FIG. 8, pressing end 44 of the actuator presses or clamps the flat circuit against contact portions 36 and 46 of the terminals. The pressing end of the actuator moves beneath the distal ends of the rigid upper cam arms 24*a* of second terminals 24 as platform surfaces 48*a* of the actuator engage the undersides of the rigid upper cam arms. The circuit is biased against contact portions 36 and 46 of the terminals by the combined forces of upper hook arms 22*a* of first terminals 22 and pressing end 44 of the actuator under the biasing influence of the upper cam arms 24*a* of the second terminals.

Figure 9:
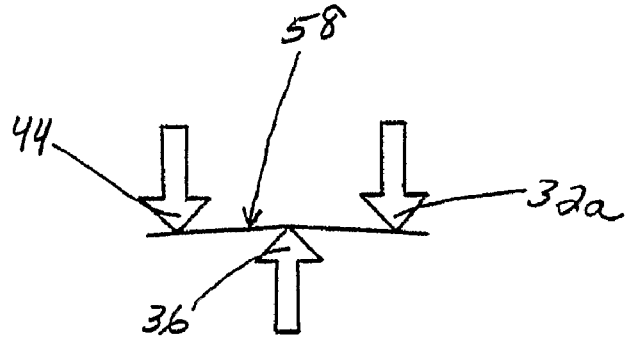
FIG. 9 is a somewhat schematic illustration showing how different forces act on the flat circuit.

FIG. 9 shows somewhat schematically these clamping forces between bearing portions 32*a* of first terminals 22, along with pressing end 44 of the actuator and contact portions 36 of the first terminals to form a three-point engagement of good electrical contact.

Figure 10:
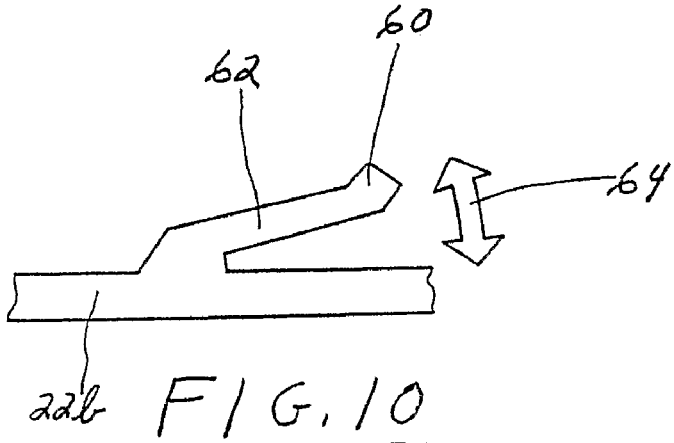
FIG. 10 is a fragmented side elevational view of a modified form of one of the first terminals.

Forming contact portion 36 on the upper edge of fixed, lower contact arm 22*b* of each first terminal 22 is advantageous to lower the profile of the overall flat circuit connector 14. This is in comparison to contact portions 60 on cantilevered contact arms 62 of the prior art as shown in FIG. 10. Although contact portion 60 can flex in the direction of arrow 64, the overall height of the connector is increased.

Figure 11:
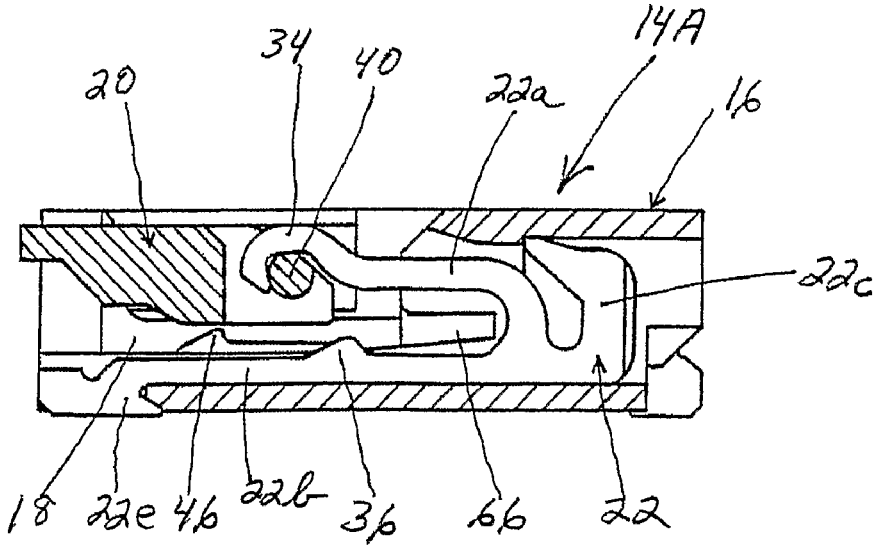
FIG. 11 is a view similar to that of FIG. 2(*a*) but showing a first terminal according to a second embodiment of the invention.
Figure 12:
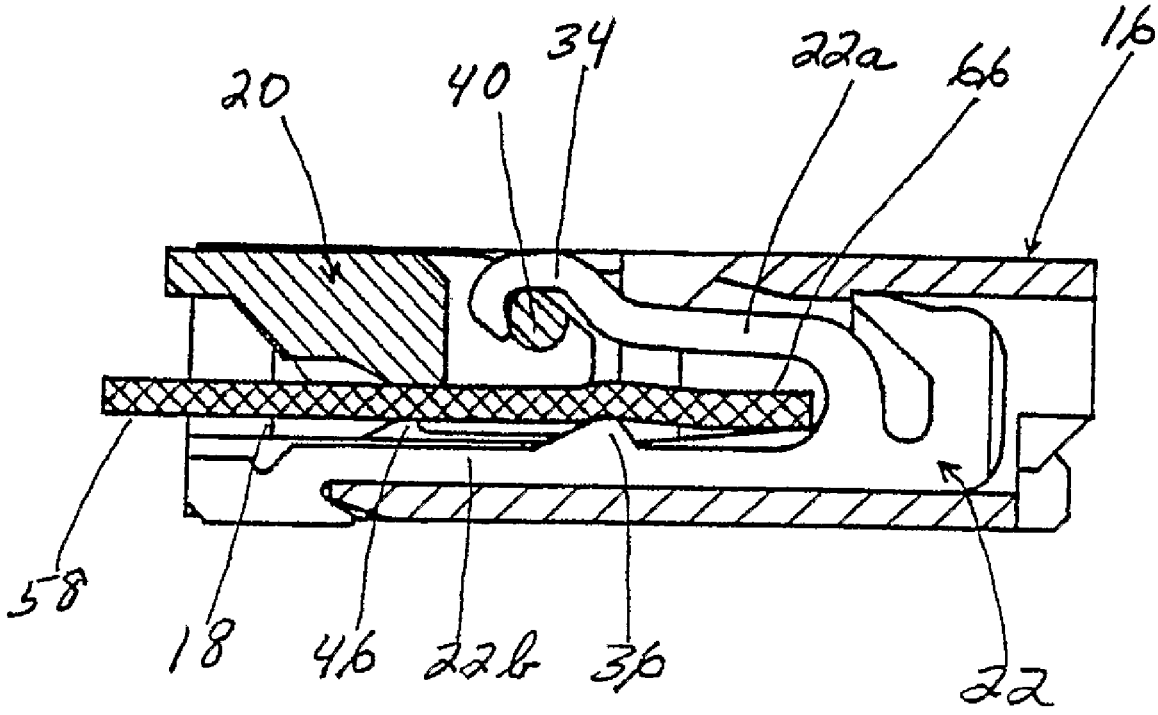
FIG. 12 is a view similar to that of FIG. 11, but with a flat circuit inserted into the connector.

FIGS. 11 and 12 show a second embodiment of a flat circuit connector, generally designated 14A. In this embodiment, upper hook arms 22*a* of first terminals 22 do not have downwardly projecting bearing portions 32*a*. In addition, dielectric housing 16 has a recess 66 to accommodate the leading end of a flat circuit. Otherwise, like reference numerals have been applied in FIGS. 11 and 12 corresponding to like components described above in relation to FIGS. 1-8.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector (14) for terminating a flat electrical circuit (58), comprising:

a dielectric housing (16) having an opening (18) at a front end (16*a*) thereof for receiving an end of the flat circuit;

a plurality of terminals (22,24) mounted on the housing in a side-by-side array and spaced laterally along the opening; and an actuator (20) movably mounted for pivotal movement between an open position allowing the flat circuit to be inserted into said opening with substantially zero insertion forces and a closed position biasing the flat circuit against contact portions of the terminals;

characterised in that:

the actuator (20) further having an intermediate position whereat the flat circuit is tentatively held in stable condition while allowing readjustment thereof.

2. The electrical connector of claim 1 wherein some (22) of said terminals are generally U-shaped to define an upper hook arm (22*a*) extending over the opening (18) and a lower contact arm (22*b*) extending below the opening, the hook arm having a bearing portion (32*a*) and the contact arm having a contact portion (36), with the flat circuit (58) being tentatively held between the bearing portion and the contact portion in said intermediate position of the actuator.

3. The electrical connector of claim 2 wherein said some of the terminals (22) are mounted on the housing (16) from the front end (16*a*) of the housing.

4. The electrical connector of claim 2 wherein said some of the terminals (22) have tail portions (22*e*) for connection to appropriate circuit traces on a printed circuit board.

5. The electrical connector of claim 2 wherein said some of the terminals (22) have hook portions (34) cooperating with pivot means (40) on the actuator (20) to mount the actuator for pivotal movement between said positions.

6. The electrical connector of claim 1 wherein some (24) of said terminals are generally U-shaped to define an upper cam arm (24*a*) extending over the opening (18) and a lower contact arm (24*b*) extending below the opening, the upper cam arm engaging a cam portion (48*b*) of the actuator (20) to lift the actuator in said intermediate position thereof.

7. The electrical connector of claim 6 wherein said some of the terminals (24) are mounted on the housing (16) from a rear end (16*b*) of the housing.

8. The electrical connector of claim 6 wherein said some of the terminals (24) have tail portions (24*e*) for connection to appropriate circuit traces on a printed circuit board.

9. The electrical connector of claim 1 wherein some (22) of said terminals have detent means (40*b*) engageable with complementary detent means (34*a*) on the actuator (20) to hold the actuator in said intermediate position thereof.

10. The electrical connector of claim 9 wherein said detent means comprise interengaging flat surfaces (34*a*,40*b*) on the actuator (20) and said some of the terminals (22).

11. The electrical connector of claim 1, including at least one fitting nail (26) fixed to the housing (16) for securement to a printed circuit board, the fitting nail having a bearing portion (26*d*) for engaging the actuator (20) and facilitating pivotally mounting the actuator on the connector.

12. An electrical connector (14) for terminating a flat electrical circuit (58), comprising:

a dielectric housing (16) having an opening (18) at a front end (16*a*) thereof for receiving an end of the flat circuit;

a plurality of terminals (22,24) mounted on the housing in a side-by-side array and spaced laterally along the opening;

an actuator (20) movably mounted for pivotal movement between an open position allowing the flat circuit to be inserted into said opening with substantially zero insertion forces and a closed position biasing the flat circuit against contact portions of the terminals;

a first plurality of said terminals (22) being generally U-shaped to define an upper hook arm (22*a*) extending over the opening (18) and a lower contact arm (22*b*) extending below the opening, the hook arm having a bearing portion (32*a*) and the contact arm having a contact portion (36), with the flat circuit (58) being tentatively held between the bearing portion and the contact portion in said intermediate position of the actuator; and a second plurality of said terminals (24) being generally U-shaped to define an upper cam arm (24*a*) extending over the opening (18) and a lower contact arm (24*b*) extending below the opening, the upper cam arm engaging a cam portion (48*b*) of the actuator (20) to lift the actuator in said intermediate position thereof;

characterised in that:

the actuator (20) further having an intermediate position whereat the flat circuit is tentatively held in stable condition while allowing readjustment thereof.

13. The electrical connector of claim 12 wherein said first terminals (22) are mounted on the housing (16) from the front end (16*a*) thereof and said second terminals (24) are mounted on the housing from the rear end (16*b*) thereof.

14. The electrical connector of claim 12 wherein all of said terminals (22,24) have tail portions (22*e*,24*e*) for connection to appropriate circuit traces on a printed circuit board.

15. The electrical connector of claim 12 wherein said first terminals (22) have hook portions (34) cooperating with pivot means (40) on the actuator (20) to mount the actuator for pivotal movement between said positions.

16. The electrical connector of claim 12 wherein said first terminals (22) have detent means (40*b*) engageable with complementary detent means (34*a*) on the actuator (20) to hold the actuator in said intermediate position thereof.

17. The electrical connector of claim 16 wherein said detent means comprise interengaging flat surfaces (34*a*,40*b*) on the actuator (20) and the first terminals (22).

18. The electrical connector of claim 12, including at least one fitting nail (26) fixed to the housing (16) for securement to a printed circuit board, the fitting nail having a bearing portion (26*d*) for engaging the actuator (20) and facilitating pivotally mounting the actuator on the connector.

* * * * *